US006820657B1

(12) United States Patent
Hedrick

(10) Patent No.: US 6,820,657 B1
(45) Date of Patent: Nov. 23, 2004

(54) APPARATUS FOR THE MANUFACTURE OF ROCK BOLTS

(75) Inventor: Neville Hedrick, Wangara (AU)

(73) Assignee: Garford Pty Ltd., Wangara (AU)

( * ) Notice: Subject to any disclaimer, the term of this patent is extended or adjusted under 35 U.S.C. 154(b) by 338 days.

(21) Appl. No.: 10/088,374

(22) PCT Filed: Sep. 5, 2000

(86) PCT No.: PCT/AU00/01043

§ 371 (c)(1),
(2), (4) Date: Mar. 13, 2002

(87) PCT Pub. No.: WO01/20131

PCT Pub. Date: Mar. 22, 2001

(30) Foreign Application Priority Data

Sep. 13, 1999 (AU) ..... PQ2745

(51) Int. Cl.[7] ..... B21F 23/00
(52) U.S. Cl. ..... 140/105; 405/259.1
(58) Field of Search ..... 140/71 R, 105; 29/461; 405/259.1

(56) References Cited

U.S. PATENT DOCUMENTS 4,237,942 A 12/1980 Dietrich
4,469,756 A 9/1984 Jungwirth et al.
5,344,256 A * 9/1994 Hedrick ..... 405/259.1

FOREIGN PATENT DOCUMENTS

AU 53034/98 8/1998
GB 2265394 9/1993

* cited by examiner

*Primary Examiner*—Lowell A. Larson
(74) *Attorney, Agent, or Firm*—Fredrikson & Byron, P.A.

(57) ABSTRACT

Apparatus and method for manufacturing multi strand rock bolts having spaced apart bulbs (12), wherein there is a feed means (14, 16, 18 and 19) for supplying a multi strand cable (11) from a rotatable supply wheel (13). Means (30, 32, 35 and 38) is provided for forming the cable (11) with bulbs (12) at spaced intervals and the position of the cable (11) is determined by a sensor means (40).

14 Claims, 1 Drawing Sheet

APPARATUS FOR THE MANUFACTURE OF ROCK BOLTS

FIELD OF THE INVENTION

The present invention relates to an apparatus for the manufacture of rock bolts.

PRIOR ART

In Australian Patent Number 640906 there is described and claimed an apparatus for the manufacture of a multi-strand rock bolt which is formed with bulbs or expanded portions in which a king wire is disposed at the periphery of the bulb.

BRIEF DESCRIPTION OF THE INVENTION

The present invention provides an apparatus which is for the manufacture of multi-strand rock bolts formed with bulbs in which the feed material is fed from a rotatable reel.

In accordance with one aspect of the present invention there is provided an apparatus for manufacturing multi-strand rock bolts having spaced apart bulbs formed therein, characterised by a feed means for supplying a multi-strand cable from a rotatable supply reel, a means for forming the cable with bulbs at spaced intervals and a means for determining the position of the cable to stop operation of the feed means to enable a further bulb to be formed.

Preferably, means is provided for sensing the position of an already formed bulb to stop operation of the feed means. The means for sensing the position of a formed bulb may comprise a sensor means having means which are moved away from the cable by the formed bulb so as to cause a signal to be sent to the feed means to stop operation thereof.

Further, a brake is preferably provided to hold the multi strand cable in a desired position when the feed means is stopped.

The feed means preferably has a plurality of rollers which clamp the multi strand cable to cause it to be fed from the supply reel. One of the rollers of the feed means may be rotably driven by a drive means.

Further, the apparatus typically has means for forming a bulb in the form of pairs of opposed jaws which are initially spaced apart by a first distance, the jaws of each pair being are arranged to be brought together to clamp the multi strand cable and the pairs of jaws being subsequently arranged to be moved closer together to be spaced apart by a second smaller distance so as to form a bulb in the multi strand cable, and the pairs of jaws being arranged to subsequently release the multi strand cable and to be moved back to the position in which they are spaced apart by the first distance.

Means may be provided for collecting the multi strand cable formed with bulbs at spaced intervals on a take up reel. In this connection there may be provided an axially rotatable bail arm having a bail member which guides the multi strand cable onto the take up reel. The bail arm may have axially rotatable threaded shaft having the bail member threadedly engaged therewith so that the bail member can travel along the shaft as the latter rotates.

In accordance with a further aspect of the present invention there is provided a method of manufacturing a multi strand rock bolt having spaced apart bulbs formed therein characterised by feeding a multi strand cable from a rotatable supply reel, sensing when the cable has reached a certain position and stopping movement of the cable, forming a bulb in the stopped cable, recommencing movement of the cable and repeating the sequence.

BRIEF DESCRIPTION OF THE DRAWINGS

The present invention will now be described, by way of example, with reference to the accompanying drawings, in which.

DESCRIPTION OF THE INVENTION

Figure 1:
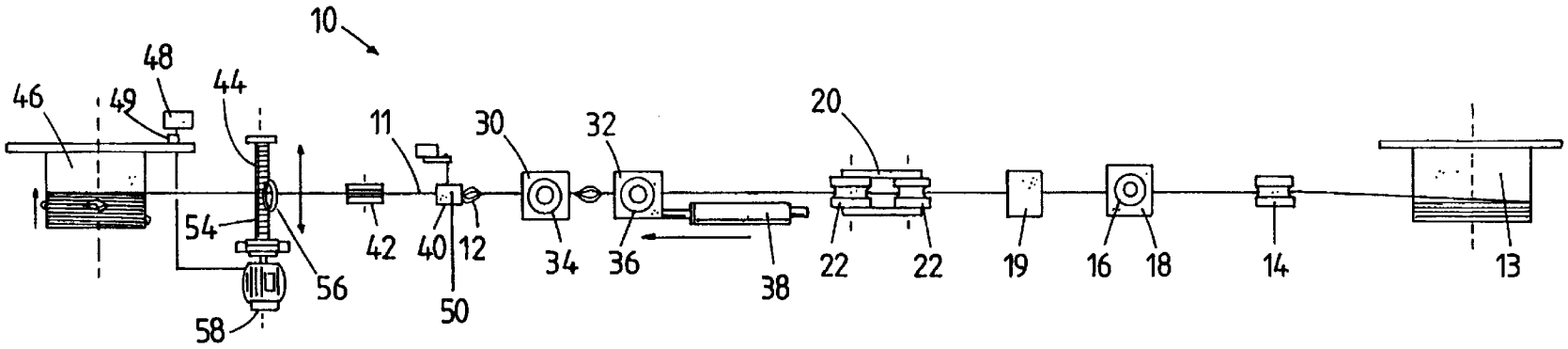
FIG. 1 is a plan view of an apparatus for the manufacture of rock bolts in accordance with the present invention.

In the accompanying drawings, there is shown an apparatus 10 for manufacturing multi-strand rock bolts 11 formed with bulbs or expanded portions 12 at spaced intervals.

The apparatus 10 includes a rotatable supply or feed reel 13 having a multi strand cable 11 wound thereabout. There is a pair of opposed grooved guide wheels 14 and an hydraulic brake 16 arranged to arrest to movement of the multi strand cable 11 by means of a pair of hydraulic relatively reciprocable members 18.

There is also provided a counter 19 to monitor the amount of multi strand cable 11 being fed from the supply reel 13.

Figure 2:
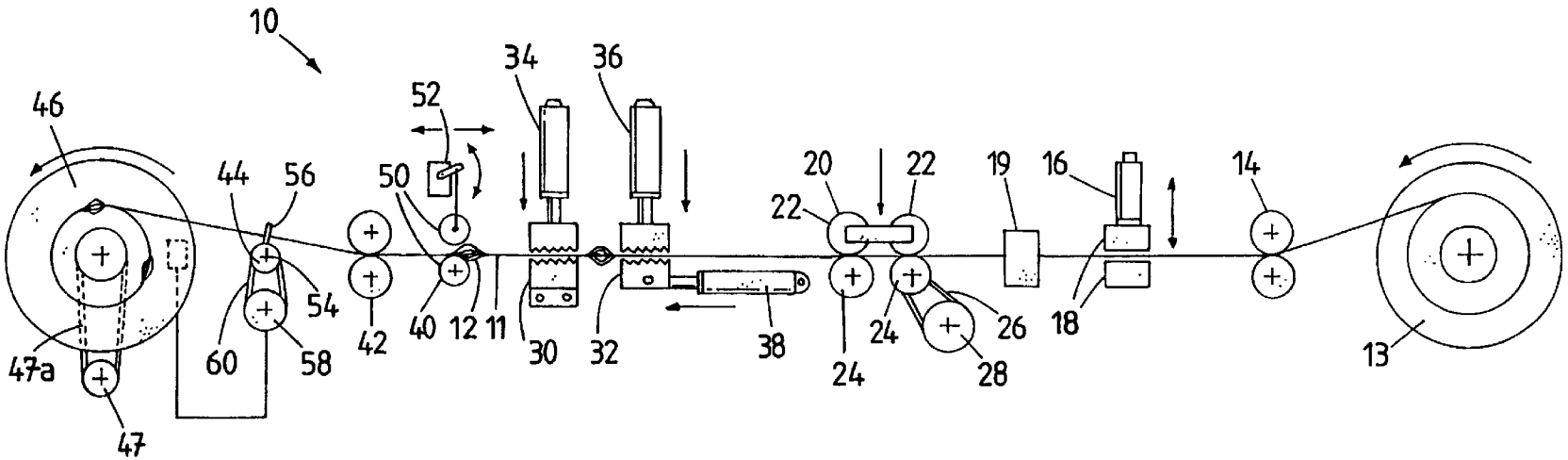
FIG. 2 is a side elevation of the apparatus of FIG. 1.

The multi strand cable 11 is fed from the supply reel 13 by a displacement device 20. The device 20 includes two upper rollers 22 and two lower rollers 24. As can be seen in FIG. 2, one of the lower rollers 24 is driven by a chain or belt 26 from a drive wheel 28. The upper rollers 22 and the lower rollers 24 are urged together such as by means of one or more pneumatic cylinders (not shown) so as to clamp or grip the multi strand cable 11 between them. Rotation of the drive wheel 28 causes corresponding rotation in the driven roller 24. As the multi strand cable 11 is gripped by the rollers 22 and 24 the multi strand cable 11 is thereby caused to be fed off the supply reel 13, through the guide wheels 14, the brake 16, the counter 19, and the displacement device 20. The drive roller 24 may be interconnected to the other roller 24 by means of a chain or belt.

The apparatus 10 further includes pairs of jaws 30 and 32 which have serrated surfaces adjacent to the multi strand cable 11. An upper one of the pair of jaws 30 is activated by an hydraulic ram 34 whilst an upper one of the pair of jaws 32 is activated by an hydraulic ram 36.

Further, the pair of jaws 32 and the associated ram 36 are arranged to be moved longitudinally in a direction generally parallel to the direction of travel of the multi strand cable 11, towards and away from the pair of jaws 30 and the ram 34. This longitudinal movement of the pair of jaws 32 is effected, in use, by a ram 38.

The apparatus 10 also has a sensor means 40 which is mounted about the multi strand cable 11 and arranged to sense a bulb in the multi strand cable 11 as will be described. Downstream of the sensor means 40 is a pair of grooved guide wheels 42. Each of the wheels 42 is disposed on a respective side of the multi strand cable 11.

Downstream of the guide wheels 42 there is provided a bail arm 44 which directs the multi strand cable 11 prior to the multi strand cable 11 being collected on a take up reel 46. The bail arm 44 ensures that the multi strand cable 11 is received on the takeup reel 46 across a predetermined width of the reel 46 rather than being taken up in an unduly narrow portion of the reel 46. Further, successive portions of the multi strand cable 11 are taken up on the reel 46 in side by side manner by the action of the bail arm 44 rather than being doubled up. The takeup reel 46 is rotatably driven by a motor 47 by means of a belt 47*a*.

Further, the apparatus 10 includes a bail arm timer 48.

The bail arm 44 includes a threaded shaft 54 with which a bail member 56 is threadedly engaged. The shaft 54 is arranged to be rotated by a motor 58 by means of a belt 60.

The bail arm timer 48 is contacted on each revolution of the reel 46 by a trip member 49 which causes the timer 48 to energise the motor 58 for a predetermined period of time. Whilst the motor 58 is energised the belt 60 causes the shaft 54 to rotate and the bail member 56 to traverse along the bail arm 44. The predetermined time of operation of the motor 58 may be varied as required so that upon each revolution of the reel 46 the bail member 56 travels along the shaft 54 a greater or lesser distance which is proportional to the time of operation of the motor 58.

The sequence of application of the apparatus of the present invention may be controlled by means of relays with timers or by computers with timing means.

In use, the multi strand cable 11 is pulled off the supply reel 13 by rotation of the driven roller 24 by means of the drive wheel 28 and the belt 26. This causes the roller 24 to rotate whilst gripping the multi strand cable 11. In this way the multi strand cable 11 is pulled off the supply reel 13, through the guide wheels 14, the brake 16 and the counter 19.

If it is desired to arrest movement of the multi strand cable 11 the relatively reciprocable members 18 of the brake 16 are moved hydraulically relative to one another to engage the multi strand cable 11. In this case, the drive to the rollers 24 would be discontinued.

In similar manner to the arrangement described in Australian patent Number 640906 the jaws 30 and 32 form spaced bulbs or expanded portions 12 at intervals in the multi strand cable 11. In this case, the king wire of the multi strand cable 11 is disposed around the periphery of each bulb 12.

The bulb forming process is commenced by a previously formed bulb 12 encountering the sensor means 40. When this happens a pair of rollers 50 of the sensor means 40 are forced apart by the previously formed bulb 12. This causes a signal to be sent from a switch 52 to the drive wheel 28 to stop drive to the rollers 24. Also, the brake 16 is hydraulically activated to arrest movement of the multi strand cable 11. Further, a signal is sent to the motor 47 to stop drive to the takeup reel 46.

When the multi strand cable 11 is stationary the pair of jaws 30 and 32 are activated by the rams 34 and 36 so as to grip the multi strand cable 11 at spaced locations. Then the pair of jaws 32 is pushed by the ram 38 towards the pair of jaws 30. As the multi strand cable 11 is gripped by the pair of jaws 30 and 32 the multi strand cable 11 is forced to expand laterally to form a bulb 12. Once formation of a bulb is completed the pairs of jaws 30 and 32 are withdrawn from the multi strand cable 11 by the rams 34 and 36 and the pair of jaws 32 is pulled away from the pair of jaws 30 by the ram 38.

Further, the rollers 22 and 24 are caused to rotate again, the brake 16 is released and the takeup reel 46 is caused to rotate again. The multi strand cable 11 is then moved along longitudinally until the newly formed bulb 12 encounters the switch means 40 and the cycle is repeated.

After the switch means 40 the multi strand cable 11 passes through the guide wheels 42 and bail arm 44. The bail arm 44 then directs the multi strand cable 11 onto the takeup reel 46 in such a manner that the multi strand cable 11 is taken up across the predetermined width of the takeup reel 46. In use, the shaft 54 rotates and the bail member 56 is thus caused, by the threaded engagement with the shaft 54, to travel along the shaft 54 for a distance corresponding to the predetermined width of the takeup reel at which it is desired to deposit the multi strand cable 11. The direction of rotation of the bail arm 54 is reversible so that the bail member 56 can travel back in the opposite direction. This may be done by means of micro switches at each end of travel of the bail member 56 which send and appropriate signal upon being contacted by the bail member 56 to cause reversal of rotation of the bail arm 56. The position of the micro switches may be varied to suite finished products of different size.

After formation of a bulb apparatus is started again by any convenient means such as manually, by means of relays with timers, or by computer timing control.

In light of the disclosure hereinabove it will be seen that the present invention provides a continuous means for the manufacture of multi strand rock bolts with bulbs formed at spaced intervals. The multi strand cable 11 on the supply reel 13 may be of a length of the order of 850 to 1300 meters whilst a corresponding length may be accommodated on the take up reel 46. The length of multi strand cable 11 on the reel 46 is somewhat shorter than the original length due to the formation of the bulbs.

It has been found that the present invention provides a more efficient means for manufacturing the multi strand rock bolts with bulbs than prior art methods. Further, the take up reel 46 having the rock bolt collected thereon can be sold directly to customers.

Also, the spacing of the bulbs 12 may be varied to suit different applications of the rock bolts.

Modifications and variations as would be apparent to a skilled addressee are deemed to be within the scope of the present invention. For example, the movement of the multi strand cable 11 could be arrested for bulb formation by means of a timer mechanism or by means of trip means on a wheel to cause the apparatus to stop at each revolution of the wheel.

What is claimed is:

1. An apparatus for manufacturing multi-strand rock bolts having spaced apart bulbs formed therein, characterised by a feed means for supplying a multi-strand cable from a rotatable supply reel; a means for forming the cable with bulbs at spaced intervals and a means for determining the position of the cable to stop operation of the feed means to enable a further bulb to be formed.

2. An apparatus according to claim 1, characterised in that the means for determining the position of the cable comprises means for sensing the position of a formed bulb.

3. An apparatus according to claim 2, characterised in that the means for sensing the position of a formed bulb comprises a sensor means having means which are moved away from the cable by the formed bulb so as to cause a signal to be sent to the feed means to stop operation thereof.

4. An apparatus according to claim 3, characterised in that a brake is provided to hold the multi strand cable in a desired position when the feed means is stopped.

5. An apparatus according to any one of the preceding claims, characterised in that the feed means has a plurality of rollers which clamp the multi stand cable to cause it to be fed from the supply reel.

6. An apparatus according to claim 4, characterised in that at least one of the rollers of the feed means is rotatably driven by a drive means.

7. An apparatus according to any one of claims 1–4 and 6, characterised in that the means for forming a bulb has pairs of opposed jaws which are initially spaced apart by a first distance, the jaws of each pair being are arranged to be brought together to clamp the multi strand cable and the pairs of jaws being subsequently arranged to be moved closer together to be spaced apart by a second smaller distance so as to form a bulb in the multi strand cable, and the pairs of jaws being arranged to subsequently release the multi strand cable to be moved back to the position in which they are spaced apart by the first distance.

8. An apparatus according to any one of claims 1–4 and 6, characterised in that means is provided for collecting the multi strand cable formed with bulbs at spaced intervals on a take up reel.

9. An apparatus according to claim 8, characterised in that there is provided an axially rotatable bail arm having a bail member which guides the multi strand cable onto the take up reel.

10. An apparatus according to claim 9, characterised in that the bail arm has a axially rotatable threaded shaft and the bail member is threadedly engaged with the threaded shaft such that the bail member can travel along the shaft as the latter rotates.

11. An apparatus according to claim 10, characterised in that a bail arm timer is provided which cooperates with a trip member associated with the take up reel, such that engagement of the trip member with the timer causes the threaded shaft of the bail arm to be rotated for a predetermined time thus causing the bail member to travel along the bail arm for a predetermined distance.

12. A method of manufacturing a multi strand rock bolt having spaced apart bulbs formed therein characterised by a multi strand cable from a rotatable supply reel, sensing when the cable has reached a certain position and stopping movement of the cable, forming a bulb in the stopped cable, recommencing movement of the cable and repeating the cycle.

13. A method according to claim 12, characterised in that the cable formed with bulbs is collected on a take up reel.

14. A method according to claim 13, characterised in that the cable is fed on to the take up reel over a predetermined width in such manner as to collect the cable substantially evenly across that width.

* * * * *